United States Patent [19]

Drake

[11] Patent Number: 4,511,307

[45] Date of Patent: Apr. 16, 1985

[54] CENTRIFUGAL PUMP

[75] Inventor: Eldon L. Drake, Shawnee, Okla.

[73] Assignee: Dresser Industries, Inc., Dallas, Tex.

[21] Appl. No.: 529,058

[22] Filed: Sep. 2, 1983

[51] Int. Cl.[3] ..... F04D 29/02; F04D 29/04

[52] U.S. Cl. ..... 415/172 R; 415/169 R; 415/170 A; 308/DIG. 8

[58] Field of Search ..... 415/170 A, 172 A, 169 A, 415/169 R, 199.1, 199.2, 199.3, 199.4, 199.5, 199.6, 172 R, 206, 111, 110, 142, 173 R, 173 A, 174, 219 C; 277/DIG. 6; 308/DIG. 8

[56] References Cited

U.S. PATENT DOCUMENTS

| | | | |
|---|---|---|---|
| 972,366 | 10/1910 | Guy | 415/172 R |
| 1,783,427 | 12/1930 | Jennings | 415/170 A |
| 2,013,078 | 9/1935 | Slocum | 103/88 |
| 2,034,790 | 3/1936 | Arutunoff | 415/170 A |
| 2,066,505 | 1/1937 | Wolfe | 415/170 A |
| 2,700,935 | 2/1955 | Teague, Jr. | 415/199.4 |
| 2,971,468 | 2/1961 | McDoniel | 415/172 R |
| 2,980,475 | 4/1961 | Wolfe | 308/DIG. 8 |
| 3,022,685 | 2/1962 | Armacost | 308/DIG. 8 |
| 3,512,788 | 5/1970 | Kilbane | 277/25 |
| 3,881,840 | 5/1975 | Bunjes | 415/109 |
| 3,904,211 | 9/1975 | Dega | 277/32 |
| 4,245,952 | 1/1981 | Eberhardt | 415/170 A |
| 4,249,913 | 2/1981 | Johnson et al. | 415/172 A |

FOREIGN PATENT DOCUMENTS

| | | | |
|---|---|---|---|
| 0635284 | 11/1978 | U.S.S.R. | 415/199.6 |

*Primary Examiner*—Robert E. Garrett
*Assistant Examiner*—H. Edward Li
*Attorney, Agent, or Firm*—Roy Van Winkle; John N. Hazelwood

[57] ABSTRACT

The centrifugal pump is of the submersible type and is useful in pumping sand laden fluids. The pump includes a rotatable impeller and fixed diffuser and has an improved bearing that comprises an annular thrust member that is constructed from material having a hardness greater than the hardness of sand. The thrust member is attached to the impeller and has a bearing surface thereon. A second annular bearing member, which is also constructed from material having hardness greater than sand, is attached to the diffuser and has a bearing surface thereon disposed in juxtaposition with the bearing surface on the thrust member.

6 Claims, 3 Drawing Figures

CENTRIFUGAL PUMP

BACKGROUND OF THE INVENTION

This invention relates generally to improvements in centrifugal pumps. More specifically, but not by way of limitation, this invention relates to submersible centrifugal pumps useful in producing fluids from a well wherein the fluids are laden with sand.

Many wells, oil wells for example, are produced from subterranean zones that are composed of unconsolidated sand. With such unconsolidated sand, the sand grains are picked up in the fluid and passed through a pump which is forcing the oil to the surface from the subterranean zone. Sand is, of course, very hard, and very abrasive and when passing through the normally constructed submersible centrifugal pumps, causes considerable erosion of the parts therein.

One part of such pumps that is very susceptible to wear or erosion from the passage of sand therethrough, is the thrust and radial bearings. In general, a bearing of some type is located between each impeller and its adjacent diffuser. While the bearing is not in the direct flow of fluid through the pump, it is subjected to some flow and to the sand carried thereby. Thus, sand is carried into the proximity of the bearing surfaces.

In the past, the material from which the bearings are constructed has not been as hard as the sand grains and consequently, the bearings were eroded by the sand. Manifestly, the prolongation of the life of a submersible pump is of considerable economic importance since the pump is usually suspended on a tubing string located in a well and the well must be shut down and the tubing string pulled along with the pump in order to repair or replace the pump if erosion takes place.

An object of this invention is to provide a new centrifugal pump having an improved bearing therein that will not be eroded by the presence of sand flowing therethrough.

SUMMARY OF THE INVENTION

This invention provides a centrifugal pump useful in pumping sand laden fluids wherein the pump includes a rotatable impeller and a fixed diffuser. An improved bearing is located in the pump and comprises an annular thrust member that is constructed from material having a hardness greater than the hardness of sand. The member is attached to the impeller and has a bearing surface thereon. The bearing also includes a second annular member constructed from a material having hardness greater than sand. The second member is attached to the diffuser and has a bearing surface thereon that is disposed in juxtaposition with the bearing surface on the thrust member. Since the materials are harder than the sand, sand coming between said bearing surfaces will not erode the surfaces, thereby prolonging the useful life of the pump when used for pumping fluids containing sand.

BRIEF DESCRIPTION OF THE DRAWING

The foregoing and additional objects and advantages of the invention will become more apparent as the following detailed description is read in conjunction with the accompanying drawing, wherein like reference characters denote like parts in all views, and wherein.

DETAILED DESCRIPTION OF THE PREFERRED EMBODIMENT

Figure 1:
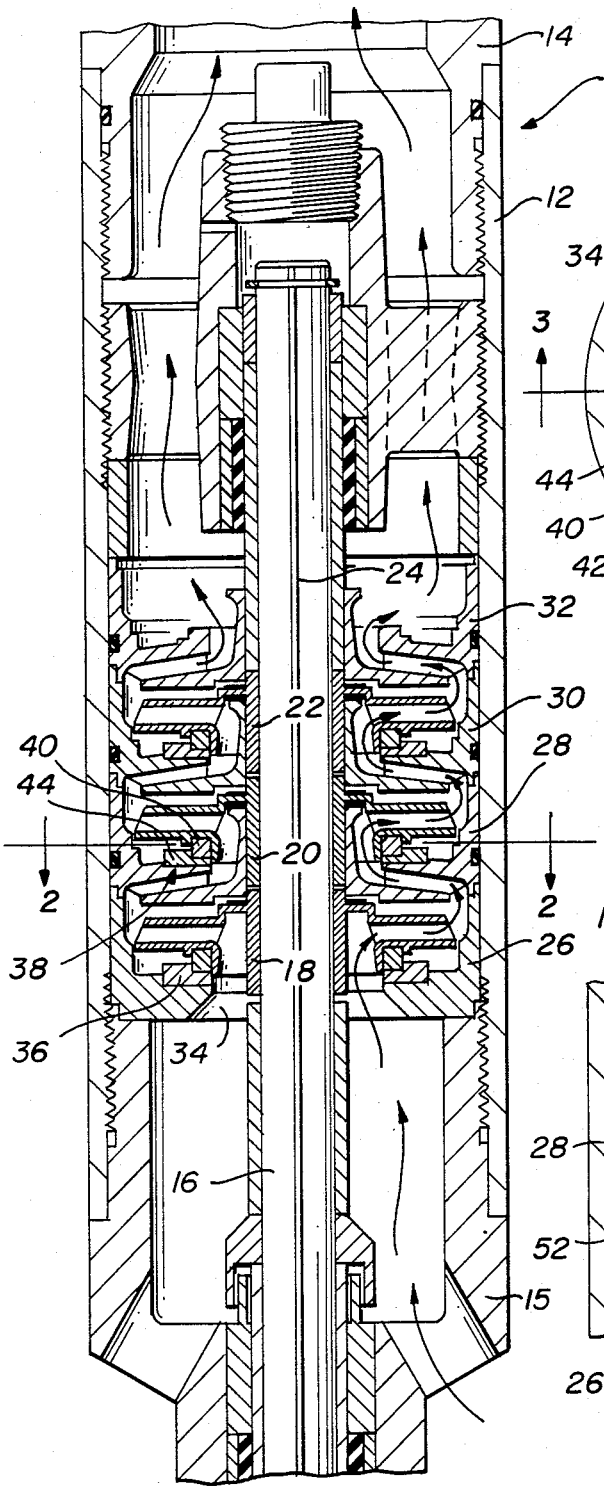
FIG. 1 is a cross-sectional elevation of a pump that is constructed in accordance with the invention.
Figure 2:
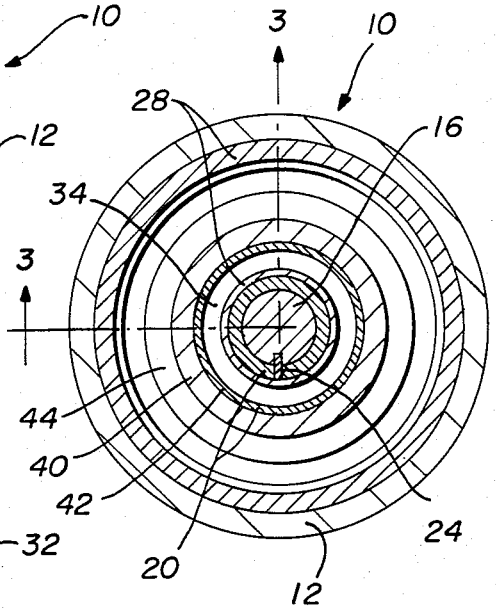
FIG. 2 is a cross-section taken through the pump of FIG. 1 and generally along the line 2—2 of FIG. 1.

Referring to the drawing and to FIG. 1 in particular, shown therein and generally designated by the reference character 10 is a submersible centrifugal pump that is constructed in accordance with the invention. The pump 10 includes a hollow housing 12 that is connected at its upper end with an adaptor 14 that is in turn connected to a tubing string 14 (not shown) which extends to the surface of the well. The lower end of the housing 12 is connected through an adaptor 15 to a device known as a sealing chamber (not shown) which has its lower end connected to an submersible electric motor (not shown) for driving the pump 10 while the submersible electric motor is not shown, a pump shaft 16 that is rotated by the motor extends upwardly into the pump 10.

The pump 10 of FIG. 1 illustrates a three-stage pump, but it will be understood, of course, that as many stages as desired may be added by appropriately lengthening the shaft 16 and the housing 12. As shown in FIG. 1, the shaft 16 is connected for rotation with impellers 18, 20 and 22 by means of a key 24. Although given different reference characters, each of the impellers may be identically constructed and interchangeable within the pump 10.

The pump 10 also includes diffusers 26, 28, 30 and 32. The diffuser 26 is the lowermost illustrated in FIG. 1 and as can be seen therein, includes a centrally located an annular opening 34 providing for the flow of fluid into the first stage impeller 18. The remaining diffusers 28, 30 and 32 may be identically constructed and interchangeable within the pump 10.

To provide for the smooth rotation of the impellers 18, 20 and 22 relative to the diffusers 26, 28 and 30, thrust bearings 36, 38 and 40 for carrying both thrust and radial loads are located between a respective impeller and diffuser. The bearings provide for the absorption of thrust loads that are imposed on the impellers as fluid is pumped upwardly by the pump 10 and provide radial support for the impellers during rotation. The thrust and radial bearings are identical in construction and therefor, only the thrust bearing 38 illustrated in the enlarged view of FIG. 3 will be described in detail.

As shown therein, the bearing 38 includes an annular thrust member 40 that is bonded to the impeller 20 in the preferred form of the invention. It will be noted that the member 40 is located adjacent to and encircles the skirt portion 42 of the impeller 20. The bearing 38 also includes a second annular member 44 that is bonded to the diffuser 28. The member 44 includes a recess 46 formed in the upper surface thereof that is disposed in juxtaposition with a lower bearing surface 48 on the thrust member 40. It will be noted that the thrust bearing surfaces on the members 40 and 44 are oriented in a radial direction relative to the centerline of the pump. The recess 46 forms a shoulder 47 in the member 44 that is disposed axially with respect to the centerline of the pump. The shoulder 47 lies in juxtaposition with a surface 50 on the thrust member 40 and provides the radial support for the impeller 20.

In manufacturing the thrust bearing 38 and the pump 10, tolerances are maintained on the thrust member 40 and the annular member 44 so that the axially oriented shoulder 47 on the member 44 and the surface 50 are disposed between 0.005" to 0.008" apart, thereby permitting the free running of the impeller relative to the diffuser.

Figure 3:
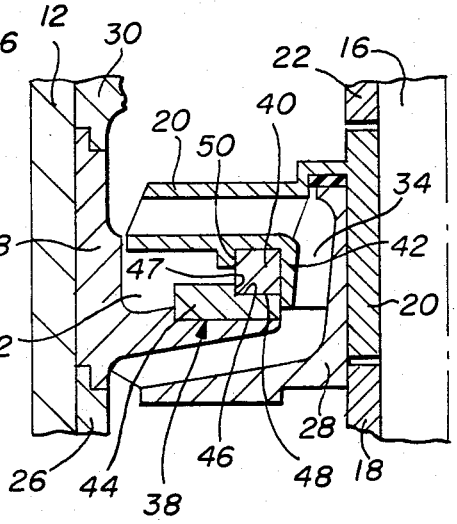
FIG. 3 is an enlarged partial cross-sectional view taken generally along the line 3—3 of FIG. 2, illustrating a thrust bearing that is constructed in accordance with the invention and that is located in the pump.

It will also be noted in FIG. 3 that the impeller 20 extends outwardly toward the diffuser 28 and is very close to the diffuser 28 at its outer diameter. There is no seal at this position. Therefore, fluid and sand will recirculate into a cavity 52 located between the rotor 20 and the diffuser 28 and through the thrust bearing 38 into the diffuser 28.

In the preferred form of the invention, the bearings 36, 38 and 40 are constructed from aluminum oxide which has a hardness of 9.0 on the MOH scale. Silicon sand has a hardness of 5.5 to 6.5 on the same scale. The bearings could be constructed from any suitable material having a hardness greater than the hardness of sand.

OPERATION

With the pump 10 positioned in the well (not shown), power is applied to the motor to cause the shaft 16 to rotate. Upon rotation of the shaft 16, the impellers 18, 20 and 22 also rotate and fluid is drawn into the pump 10 and passes through the diffusers and rotors as illustrated by the arrows in FIG. 1.

However, and as previously mentioned, the impellers do not actually contact the diffusers at the outer diameter of the impellers and therefore, fluid is recirculated into the chamber 52. Across each of the impellers there is approximately 10 psi pressure increase so that in the chamber 52 there will be a pressure that is approximately 10 psi higher than the pressure in the diffuser flow path that is on the other side of the bearing 38. In view of this differential in pressure, fluid will flow through the thrust bearing 38, that is, fluid will flow between the thrust member 40 and the second member 44 thereof. Indeed, such flow provides a fluid bearing or fluid film located between the two members and thus, prevents direct running contact between the bearing members during operation of the pump 10.

As would be expected, some sand is carried by the fluid into the bearings. As previously mentioned, the clearance between the thrust member 40 and the second member 44 along the shoulder 47 thereof, is only between 0.005" to 0.008". The general size of sand grains is approximately 0.013" to 0.15" and larger. Thus, the sand grains cannot directly enter into the bearings, but are deposited by the fluid flow in the entry to the space. Eventually, the sand grains break down to a size so that they can pass between the bearing surfaces.

Insofar as has been determined, no wear on the bearing surfaces occurs due to the sand. Extensive tests have been run on the pump, and with substantially higher quantities of sand in the fluid than will normally be encountered in wells with no measurable wear indicated on the bearings. The sand grains recovered were substantially reduced in size to approximately 50 microns or less. Thus, the sand produced will flow with the produced fluid to the surface of the well without harming the pump.

From the foregoing, it will be appreciated that the improved centrifugal pump having the improved thrust and radial bearing therein has a considerably extended life over a pump that is manufactured according to usual standards. The improved bearing construction avoids the necessity of frequent removal of the pump from the well and replacement of the parts therein.

The foregoing detailed description is presented by example only and many modifications and changes can be made thereto without departing from the spirit of the invention.

The embodiments of the invention in which an exclusive property or privilege is claimed are defined as follows:

1. In a centrifugal pump useful in pumping sand laden fluids, said pump including a rotatable impeller and a fixed diffuser, improved bearing means comprising:

an annular thrust member constructed from a material having a hardness greater than the hardness of sand, said member being attached to said impeller and having a bearing surface; and an annular second member constructed from a material having a hardness greater than the hardness of sand, said second member being attached to said diffuser and having a bearing surface disposed in juxtaposition with the bearing surface on said thrust member to absorb thrust loading of said impeller, and whereby sand coming between said bearing surfaces will not erode said surfaces thereby prolonging the useful life of said pump when used for pumping fluids containing sand.

2. In the centrifugal pump of claim 1 wherein:

said annular thrust member includes a second bearing surface; and said second member includes a second bearing surface disposed in juxtaposition with the second bearing surface on said annular thrust member to absorb radial loading of said impeller.

3. In the centrifugal pump of claim 2 wherein:

said first mentioned bearing surfaces are radially disposed with respect to a rotational axis of the pump; and said second bearing surfaces are axially disposed with respect to the rotational axis of the pump.

4. In the centrifugal pump of claim 3 wherein:

said second member has an annular recess therein defining said first mentioned and second bearing surfaces thereon; and said thrust member is, at least, partially disposed in said recess.

5. In the centrifugal pump of claim 4 wherein:

said thrust member is retained in said impeller by an adhesive; and, said second member is retained in said diffuser by an adhesive.

6. In the centrifugal pump of claim 5 wherein said thrust member and second member are constructed from aluminum oxide.

* * * * *